US007670145B2

(12) United States Patent
Cheng

(10) Patent No.: US 7,670,145 B2
(45) Date of Patent: Mar. 2, 2010

(54) ELECTRICAL CONNECTOR ASSEMBLY

(75) Inventor: Yung-Chang Cheng, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 100 days.

(21) Appl. No.: 11/986,195

(22) Filed: Nov. 20, 2007

(65) Prior Publication Data

US 2008/0119082 A1 May 22, 2008

(30) Foreign Application Priority Data

Nov. 20, 2006 (TW) ..... 95220403 U

(51) Int. Cl.
*H01R 13/60* (2006.01)

(52) U.S. Cl. ..... 439/41

(58) Field of Classification Search ..... 439/41, 439/629, 940, 345, 149, 157, 159
See application file for complete search history.

(56) References Cited

U.S. PATENT DOCUMENTS 5,026,295 A * 6/1991 Fong et al. ..... 439/135
5,688,133 A * 11/1997 Ikesugi et al. ..... 439/135
5,899,760 A * 5/1999 Ho et al. ..... 439/135
6,019,617 A * 2/2000 Liu et al. ..... 439/135
6,116,949 A * 9/2000 Costello et al. ..... 439/509
6,210,225 B1 * 4/2001 Cai et al. ..... 439/607
6,371,776 B1 * 4/2002 Li et al. ..... 439/135
6,439,901 B1 * 8/2002 Ji et al. ..... 439/135
6,506,064 B1 * 1/2003 Wu ..... 439/135
7,232,317 B2 * 6/2007 Ookura ..... 439/74
7,393,219 B2 * 7/2008 Liao ..... 439/135
2008/0188103 A1 * 8/2008 Liao ..... 439/135

* cited by examiner

*Primary Examiner*—T C Patel
*Assistant Examiner*—Harshad C Patel
(74) *Attorney, Agent, or Firm*—Andrew C. Cheng; Wei Te Chung; Ming Chieh Chang

(57) ABSTRACT

An electrical connector assembly comprises an insulating housing (1), a plurality of terminals (2) retained in the insulating housing and a picking up section (5) mounted on the insulating housing. Wherein the insulating housing has a base section (10) and an engaging plate (14) extending backwardly from the base section. The picking up section comprises a plurality of elastic clasps (52) engaging with the opposite sides of the engaging plate directly.

13 Claims, 4 Drawing Sheets

ELECTRICAL CONNECTOR ASSEMBLY

BACKGROUND OF THE INVENTION

1. Field of the Invention

The present invention relates to an electrical connector assembly, and more particularly to an electrical connector assembly with a simple structure.

2. Description of Prior Arts

When an electrical connector is mounted on a Printed Circuit Board (PCB), it is necessary that a soldering portion of the electrical connector connects exactly with a soldering point of the PCB. Usually, a vacuum sucking mechanism can complete the operation by sucking on a picking up section mounted on the electrical connector. The picking up section has a slippy surface fastening with the sucking mechanism, and a plurality of elastic sections for fastening on corresponding locking parts of the electrical connector.

However, prior art picking up section locking with the electrical connector by a plurality of locking parts formed on an insulating housing of the electrical connector. So the insulating housing usually is complex, and hard to operate. Additionally, the electrical assembly is withdrew upwardly from the electrical connector. If the force carrying the picking up section is too fiercely, the soldering portion of the electrical connector may fall off from the PCB, leading to an undesirable connection between the electrical connector and the PCB.

SUMMARY OF THE INVENTION

An object, therefore, of the invention is to provide an electrical connector assembly, which is mounted on an engaging plate of an insulating housing directly.

In the exemplary embodiment of the invention, an electrical connector assembly comprises an insulating housing, a plurality of terminals retained in the insulating housing, a picking up section mounted on the insulating housing. Wherein the insulating housing has a base section and an engaging plate extending backwardly from the base section. The picking up section comprises a plurality of elastic clasps engaging with the opposite sides of the engaging plate directly.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
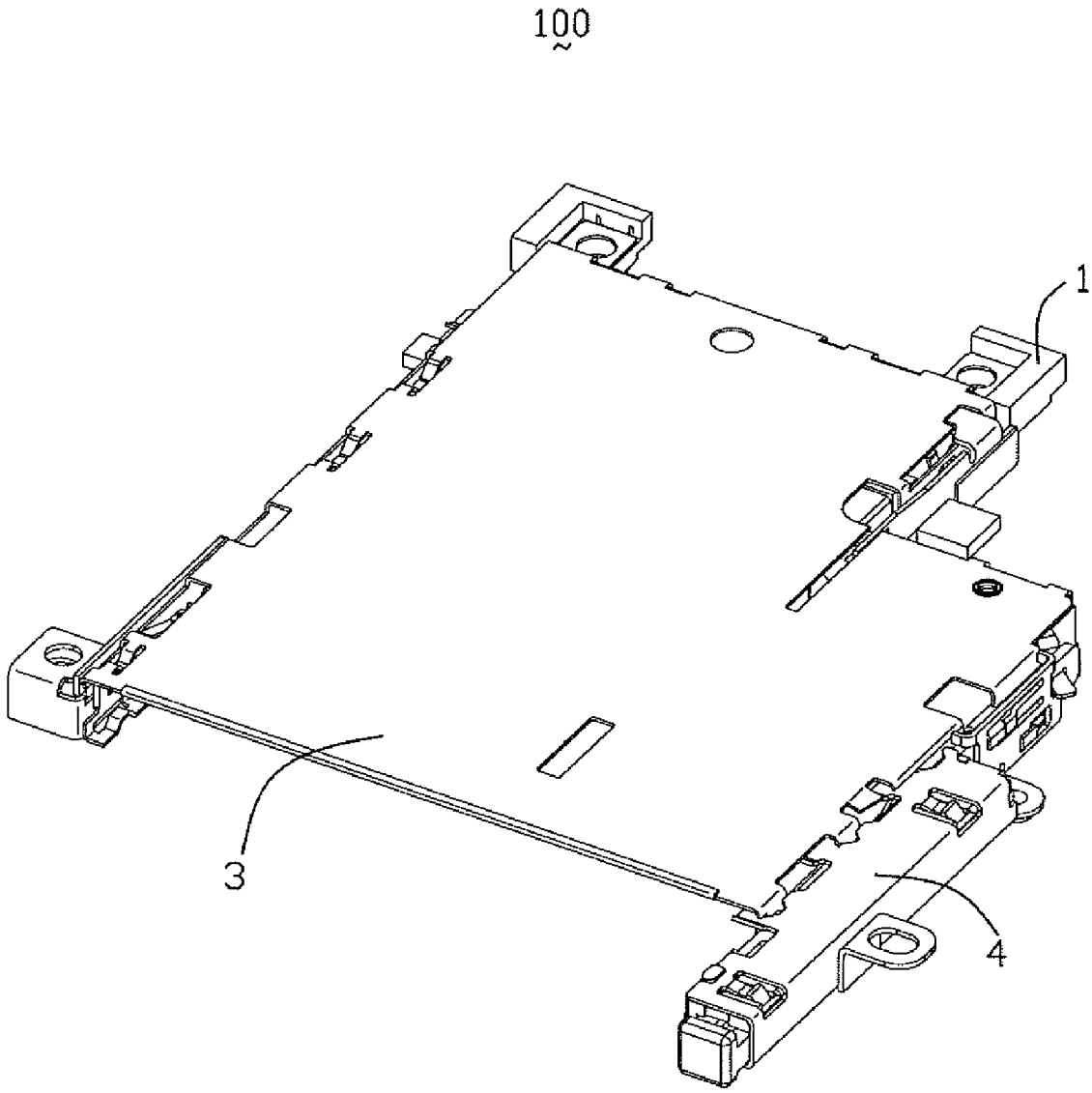
FIG. 1 is a perspective, assembly view of an electrical card connector.
Figure 2:
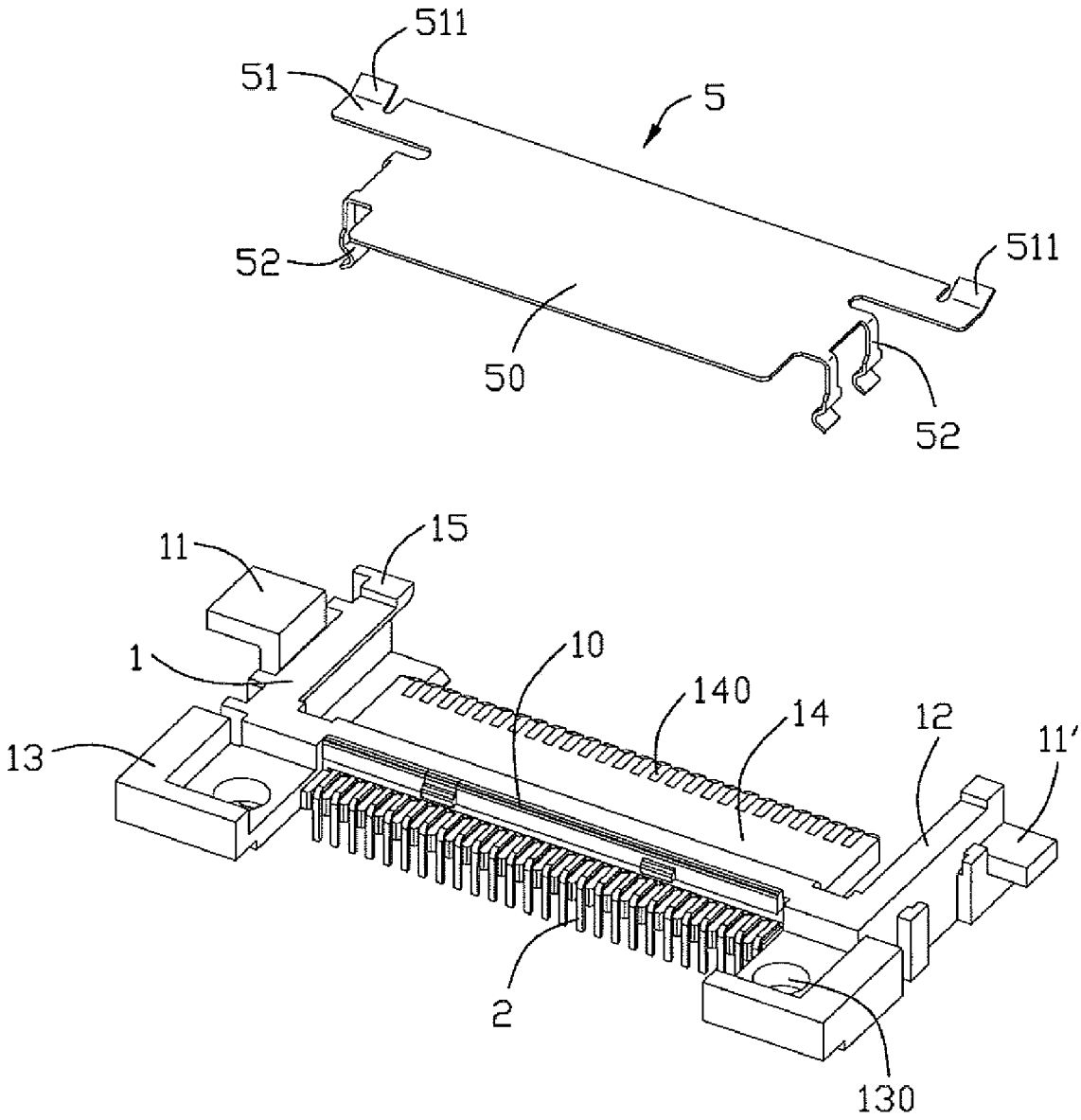
FIG. 2 is a perspective view of a picking up section of the present invention and an insulating housing of the electrical card connector.

As shown in FIG. 1 to FIG. 2, an electrical connector assembly comprises an electrical card connector 100 and a picking up section 5. The electrical card connector 100 has an insulating housing 1, a plurality of terminals 2 retained in the insulating housing 1, a shell 3 mounted on the insulating housing 1, and an ejecting member 4 located at a side of the shell 3. The shell 3 and the insulating housing 1 define a card slot (not labeled) allowing the card inserted or ejected.

As shown in FIG. 2, the insulating housing 1, configured of a longitudinal shape, comprises a transverse base section 10, a pair of arms 12 extending backwardly from the opposite heads of the base section 10, and an engaging plate 14 extending backwardly from the base section 10 between the arms 12. A step 15 protrudes uprightly from each end of the arms 12. The terminals 2 go through a plurality of passageways 140 of the engaging plate 14 for engaging with an inserted card.

Figure 3:
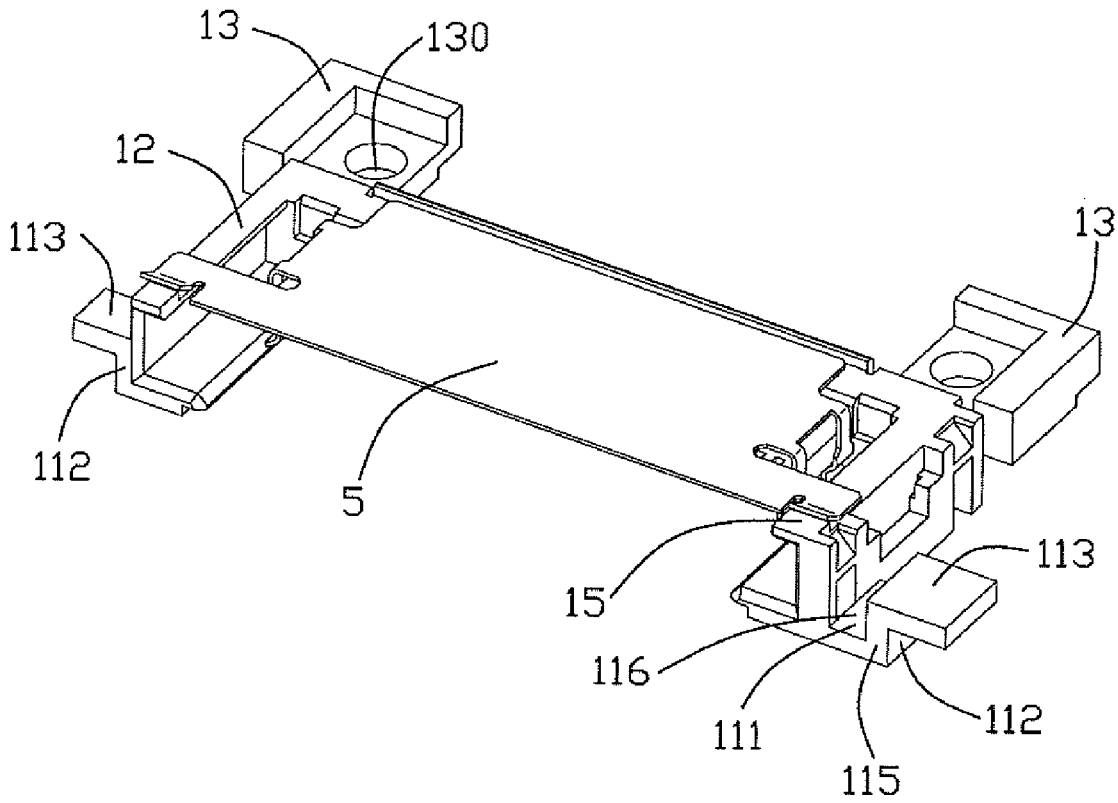
FIG. 3 is a perspective view of the picking up section mounted on the insulating housing.

As shown in FIG. 2 and FIG. 3, the arms 12 of the insulating housing 10 has a pair of holding portions 11 and 11' extending outwardly from corresponding outside wall of the arms 12, for partially loading the electrical card connector 100 in a hole of a PCB (not shown). The holding portion 11 includes a level section 111 extending horizontally from one arm 12, a vertical section 112 extending perpendicularly from the level section 111, and a supporting section 113 extending horizontally and outwardly from the vertical section 112. The bottom face of the level section 111 and the bottom face of the arm 12 are in the same plate or level, additionally, the level section 111 and the vertical section 112 define a joining body 115. Therefore, a groove 116 is defined between the joining body 115 and one arm 12. The other holding portion 11' includes a vertical section 112 joining with the outside of the other arm 12, and a supporting section 113 extending horizontally and outwardly from the vertical section 112, therefore, a groove is not defined therebetween. Each supporting section 113 of the holding portions 11 and 11' engages with the edge of the hole of the PCB, respectively. A projecting pole (not labeled) of the ejecting member 4 (shown in FIG. 1) goes through the groove thereby projecting into the card slot to engage with the card.

Figure 4:
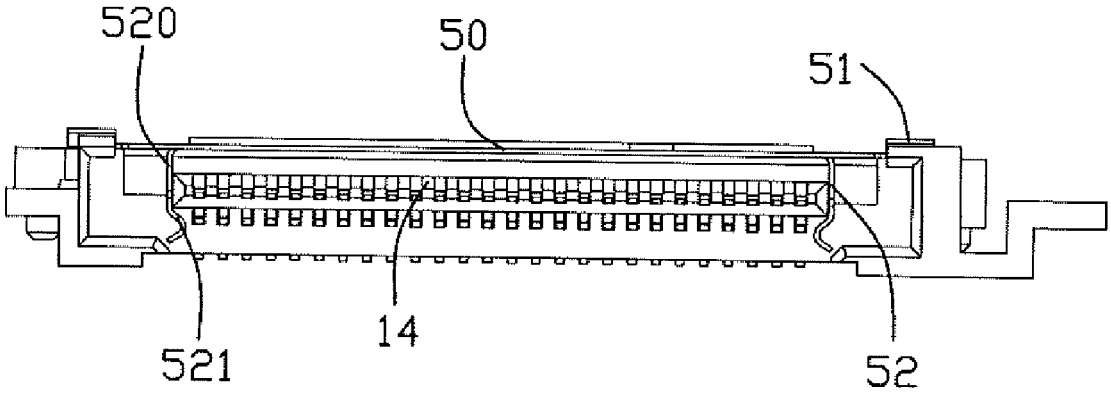
FIG. 4 is a front elevational view shown in FIG. 3.

As shown in FIG. 2 to FIG. 4, the picking up section 5, configured in accordance with the insulating housing 1, comprises a body plate 50, two pairs of elastic clasps 52 tending downwardly from the opposite sides of the body plate 50, and a pair of engaging limbs 51 extending horizontally and sidewardly from the opposite sides of the body plate 50. Both engaging limbs 51 have a guiding piece 511 rising at an inclination in a card ejecting direction. Each elastic clasp 52 comprises an attaching portion 520 and a clasping section 521. The clasping sections 521 project towards the card slot and structure almost as an arc. The body plate 50 is slippy and horizontal for a sucking mechanism (not shown) sucking and picking up.

With FIG. 3 and FIG. 4, the relationship between the insulating housing 1 and the picking up section 5 would be described in following segments. Pressing the picking up section 5 downwardly, and the elastic clasps 52 engage with the opposite sides of the engaging plate 14. Thereafter, further pressing the picking up section 5 allows the clasping sections 521 to expand outwardly, until the attaching portions 520 stick to the opposite sides of the engaging portion 14, the clasping sections 521 come back to previously situation and place under the engaging plate 14. Then the clasping sections 521 engage with the bottom of the engaging plate 14, the guiding pieces 511 of the engaging limbs 51 collide with corresponding steps 15 of the insulating housing 1, and the base section 10 of the insulating housing 1 engages with head portion of the body plate 50. When the picking up section 5 is withdrew from the insulating housing 1, drawing the picking up section 5 in a card ejecting direction, together with the guiding piece 511 and the body plate 50 go beyond the steps 15 of the insulating housing 1. Therefore, the picking up section 5 is deviated from the insulating housing 1.

With the elastic clasps 52 of the picking up section 5 matching with the engaging plate 14 directly, it is unnecessary to form some fastening sections on the insulating housing 1 for the picking up section 5 to fasten. Therefore, the configuration of the insulating housing 1 is more simple, achieving a simple module of the insulating housing. Besides, the picking up section 5 is withdrew from the insulating housing 1 in a card ejecting direction, avoiding the elastic clasps removed repeatedly in a down-to-up direction leading to a degradation connection between the electrical connector and the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector assembly comprising:

an insulating housing comprising a base section, an engaging plate extending from the base section, a pair of arms extending from the opposite heads of the base section, each end of the arms comprising a step extending upwardly therefrom;

a plurality of terminals retained in the insulating housing;

a picking up section mounted on the insulating housing and comprising a pair of limbs each having a guiding piece colliding with corresponding steps of corresponding arms of the insulative housing;

wherein the picking up section comprises at least two elastic clasps engaging with the opposite sides of the engaging plate directly.

2. The electrical connector assembly as claimed in claim 1, wherein each elastic clasp comprises an attaching portion for engaging with the opposite sides of the engaging plate.

3. The electrical connector assembly as claimed in claim 1, wherein each elastic clasp comprises a clasping section located under the engaging plate and engaging with the bottom thereof.

4. The electrical connector assembly as claimed in claim 3, wherein the insulating housing defines a card slot for a card inserted and ejected, and the clasping section projects towards to the card slot.

5. The electrical connector assembly as claimed in claim 1, wherein the insulating housing comprises a pair of holding portions extending outwardly from the arms.

6. The electrical connector assembly as claimed in claim 5, wherein one holding portion defines a groove with the outside of one arm.

7. An electrical connector comprising:

an insulative housing including two opposite horizontal arms defining a pair of mating channels, and a horizontal mating tongue between said pair of mating channels in a transverse direction, said mating tongue defining two opposite transverse ends;

a plurality of terminals disposed in the housing with contacting section exposed upon the mating tongue; and a pick up cap including a main pick up plane with a pair of elastic clasps on two sides to be hooked on said two transverse ends of the mating tongue; wherein said main pick up plane faces upwardly for suction in a vertical direction perpendicular to said transverse direction.

8. The electrical connector as claimed in claim 7, wherein said main pick up plane is vertically spaced from the mating tongue but supported by other portions of the housing which is located above the mating tongue.

9. The electrical connector as claimed in claim 7, wherein the elastic clasps are located between the mating tongue and the pair of corresponding arms, respectively, along said transverse direction.

10. The electrical connector as claimed in claim 7, wherein said pick up cap and the housing are configured to allow said pick up cap to be assembled horizontally to the housing along a front-to-back direction perpendicular to both said transverse direction and said vertical direction.

11. The electrical connector as claimed in claim 10, wherein said pick up cap defines engaging limbs engaged with the corresponding aims, respectively, for retaining said pick up cap to the housing in said front-to-back direction.

12. A card connector for receiving a card, comprising:

an insulative housing including two opposite horizontal arms and a horizontal mating tongue extending between said pair of horizontal arms along a card ejection direction;

a plurality of terminals disposed in the housing with contacting sections exposed upon the mating tongue; and a pick up cap including a main pick up plane covering and located above the mating tongue, a pair of elastic clasps clasping two opposite ends of the mating tongue, and a pair of laterally extended limbs connecting to the main pick up plane, each of the pair of laterally extended limbs defining a guiding piece extending across the horizontal arms, the pick up cap structured in such a manner that the pick up cap can be assembled to the connector along a connector thickness direction while can be easily removed from the connector along the card ejection direction.

13. The card connector as claimed in claim 12, wherein the guiding piece projects slantwise towards a card insertion direction and extends beyond the main pick up plane.

* * * * *